US006092396A

United States Patent [19]

Schmid et al.

[11] Patent Number: 6,092,396

[45] Date of Patent: Jul. 25, 2000

[54] KNITTING MACHINE, IN PARTICULAR FLAT KNITTING MACHINE

[75] Inventors: Franz Schmid, Bodelshausen; Martin Wornle, Nehren, both of Germany

[73] Assignee: H. Stoll GmbH & Co., Reutlingen, Germany

[21] Appl. No.: 09/095,396

[22] Filed: Jun. 10, 1998

[30] Foreign Application Priority Data

Jun. 13, 1997 [DE] Germany ..... 197 25 073

[51] Int. Cl.[7] ..... D04B 15/06

[52] U.S. Cl. ..... 66/106; 66/104; 66/90

[58] Field of Search ..... 66/90, 104, 105, 66/106, 107, 109

[56] References Cited

U.S. PATENT DOCUMENTS

| | | | |
|---|---|---|---|
| 3,024,633 | 3/1962 | Kuntz | 66/104 |
| 4,713,948 | 12/1987 | Schmidt et al. . | |
| 5,134,864 | 8/1992 | Yabuta et al. | 66/106 |
| 5,134,865 | 8/1992 | Shima et al. | 66/104 |
| 5,138,849 | 8/1992 | Stoll et al. . | |
| 5,355,699 | 10/1994 | Inagaki et al. . | |

FOREIGN PATENT DOCUMENTS

| | | |
|---|---|---|
| 0 347 011 A1 | 12/1989 | European Pat. Off. . |
| 0 567 282 A1 | 10/1993 | European Pat. Off. . |
| 1 207 319 | 2/1960 | France . |
| 36 09 539 C2 | 12/1987 | Germany . |
| 39 35 763 C2 | 2/1993 | Germany . |

*Primary Examiner*—Danny Worrell
*Attorney, Agent, or Firm*—Michael J. Striker

[57] ABSTRACT

A knitting machine has a needle bed, a plurality of needles, plates arranged between the needles, each of the plates having a front operational part provided with edges engaging in a loop forming region and displaceable about an axis extending along the needle bed between a front position and a rear position, and a shaft part arranged substantially parallel to the needles and longitudinally displaceable for driving the plates, the operational part and the shaft part being connected by an elastic springy web to form a one-piece element.

15 Claims, 2 Drawing Sheets

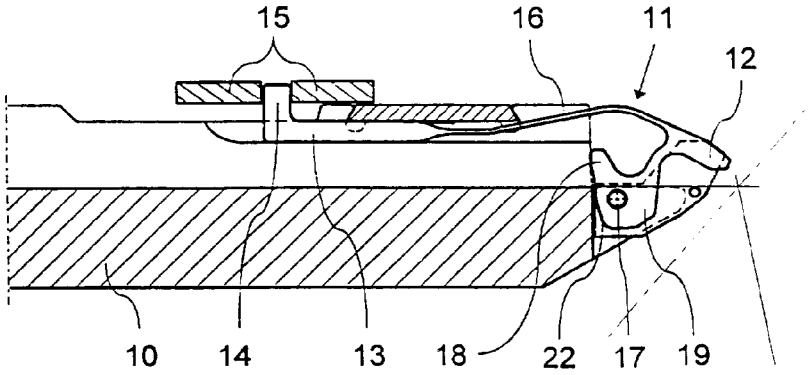
FIG. 1
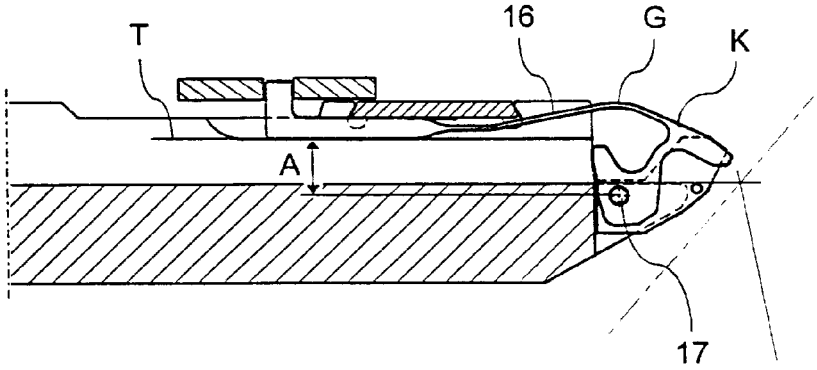
FIG. 2
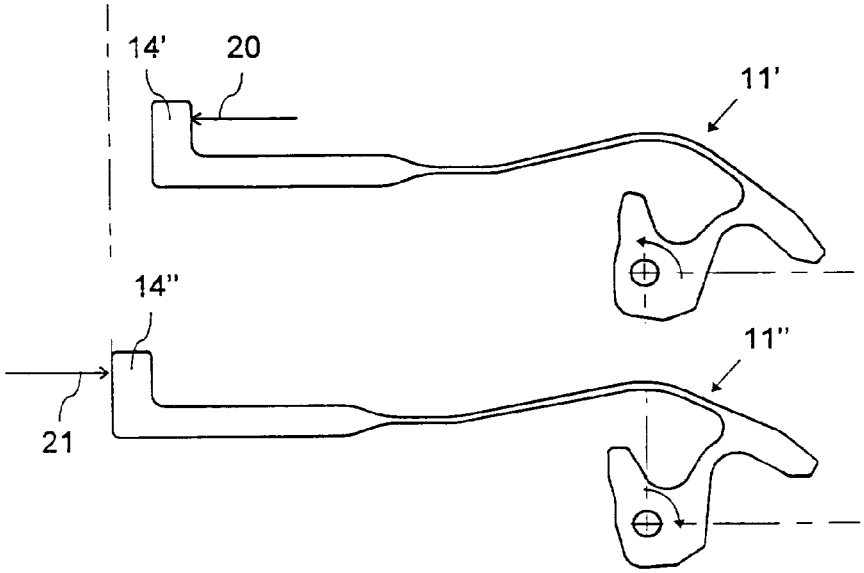
FIG. 3A
FIG. 3B

KNITTING MACHINE, IN PARTICULAR FLAT KNITTING MACHINE

BACKGROUND OF THE INVENTION

The present invention relates to knitting machines, in particular flat knitting machines.

Knitting machines with holding down plates arranged between the needles are known. With the assistance of the holding down plates, a knitting without the participation of a knitting pulling out device under the comb gap is possible. The holding down plate has an operational part with edges and projections extending in a loop formation region. The operational part can be turned between an opening and closing position. Such a holding plates are disclosed for example in the German patent document DE 36 09 539 C2 and DE 39 35 763 C2. The known holding down plates are guided in plate beds arranged above the needle beds. Cam parts slide along the upper surface of the plate beds and move the holding down plates to their opening and closing position. The plate beds however are arranged on the comb gap relatively tightly so that they affect the visibility of the knitting process as well as manual engagement in the comb gap. For this reason, holding down plates have been proposed which are subdivided into two elements including an operational part which performs the turning movement and a linearly moveable shaft part. Both parts are pivotally connected with one another. Thereby the linear movement of the driven shaft part can be converted into the required turning movement of the operational part between the opening and closing positions of the plate. Such plates are presented for example in the patent documents FR 1 207 319 and EP 0 567 282. The advantages of the two-part holding down plates, is that the control of the shaft part can be performed in a single withdrawal from the comb gap. However, these holding down plates naturally have a more expensive construction than one-piece plates.

SUMMARY OF THE INVENTION

Accordingly, it is an object of the present invention to provide a knitting machine of the above mentioned general type which avoids the disadvantages of the prior art.

More particularly, it is an object of present invention to provide a knitting machine of the above mentioned general type, which is provided with holding down plates which are formed as one-piece elements and must not be controlled in the vicinity of the comb gap region.

In keeping with these objects and with others which will to become apparent hereinafter, one feature of present invention resides, briefly stated, in a knitting machine, in particular a flat knitting machine, which has plates arranged between the needles and including a front operational part with edges engaging in a loop formation region and turnable about an axis extending along the needle bed between a front and a rear position, and a shaft part extending substantially parallel to the needles for driving the plates, wherein the operational part and the shaft part are connected with one another by an elastic springy web to form a one-piece element.

Due to the elastic spring web, a transmission of the translatory movement of the shaft part into a rotary movement of the operational part is possible. This means that the drive of the plate can be performed on the shaft part and thereby spaced from the cam gap. The springy design of the web also activates a restoring force so that the plate is automatically moved to an initial position.

In a relaxed condition of the web, the operational part of the plates can be located in the front or in the rear position, or also in an intermediate position between the front and the rear position. Depending on the stationary position, the plate must be actively driven only to one of the both positions, namely the closing position or opening position, or also to both positions. The plates can be formed as one piece stamped parts. On the other hand, they can be composed of several parts which are assembled with one another by welding. The operational parts of the plates can be guided in a known manner laterally, to secure the required exact position of their engagement in the loop formation region.

Various possibilities can be provided for driving the blades. The plates can be controlled by a 7 plate cam engaging on the plate shaft. The shaft part of the plates can be provided for this purpose with a foot projecting perpendicular from the needle bed, so that the cam part of the plate cam can engage on it. The plate cam can be arranged at a relatively greater distance from the comb gap, so that the comb gap region remains freely accessible from above.

The inventive plates can be connected however with the neighboring needles also by a frictional and/or form-locking connection and thereby move together with the needles. For this purpose the inventive holding plates can be used in carriageless knitting machines with a single-motor needle drive.

For coupling of the needle drive with the plate drive, a plurality of structural possibilities can be implemented. For example, the shaft part of the plates can be provided laterally with flat spring elements which engage in recesses of the needle shafts. In a preferable embodiment, the needle shaft can be provided with two recesses arranged one after the other, and the flat spring element of the shaft part of the neighboring plate is insertable into the recesses during a needle advance, so that the operational part of the plate after reaching a front end position abuts against an abutment whereby the flat spring element slides from the front recess to the rear recess. The coupling between the needle shaft and the plate shaft can be performed therefore alternatively through a form-locking connection and a frictional connection. When the plate web is formed so that in its immovable position the operational part of the plate is open, then for opening of the operational part no active control of the plate is performed. The plate opens completely automatically when the flat spring element engages in the rear recess.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing the cross-section of the needle bed of a flat knitting machine with a holding down plate in an open position;

FIG. 2 is a view substantially corresponding to the view of FIG. 1 and identifying the operational surfaces of the needle plate;

FIG. 3A is a side view of a needle plate in a closed position;

FIG. 3B is a view substantially corresponding to the view of FIG. 3A but showing the holding down plate in an open position;

DESCRIPTION OF PREFERRED EMBODIMENTS

Figure 4A:
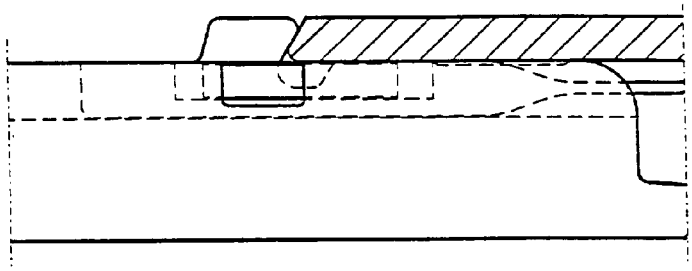
FIG. 4A is an enlarged partial view of FIG. 4.

FIG. 1 shows a partial cross-section of a needle bed 10 of a flat knitting machine with a holding down plate 11. The plate 11 has an operational part 12 which engages in a loop formation region of the knitting machine, and thereby allows a knitting without knitting article pulling out under the needle cross. The operational part 12 can have different designs depending on the desired operations. The plate 11 also has a shaft part 13 which is supported longitudinally displaceably in the needle bed 10. A plate foot 14 is arranged on the shaft part 13, and a cam part 15 of a plate cam engages the plate foot 14.

The shaft part 13 and the operational part 12 are connected with one another by an elastic springy web 16. The operational part 12 is supported turnably about an axis 17. When the plate foot 14 is acted upon by the cam part 15, a translatory movement of the shaft part 13 is provided, which is converted through the web 16 into a rotary movement of the operational part 12. The opening position of the plate 1 is limited by an abutment portion 18, while the closing position is limited by the abutment portion 22. The operational part 12 is also laterally guided by a guiding surface 19.

As can be seen from FIG. 2, the geometrical shape and the cross-section of the web 16, the length of a knot K, and the distance L of the turning point 17 from the plane T of the translatory movement of the plate shaft 13 are selected so that, by a conversion of the translatory movement of the shaft 13 into a rotary movement of the operational part 12, in the web 16 such a high tension is produced that the resulting restoring forces moves the operational part 12 and the plate part 13 exactly to their initial position. Thereby the plate cam can be formed very flat, since the movement of the plate must be conducted only in one direction. The restoring forces of the holding down plates can be taken in a corresponding cam plane.

FIG. 3.1 shows a plate 11' which in relaxed condition is located in a closing position. For opening the plate, a force must be applied in the direction of the arrow 20. FIG. 3.2, to the contrary, shows a plate 11" which in a stationary condition is located in an open position. Here for closing the plate 11", a force must be applied in the direction of arrow 21 to the plate foot 14".

Figure 4:
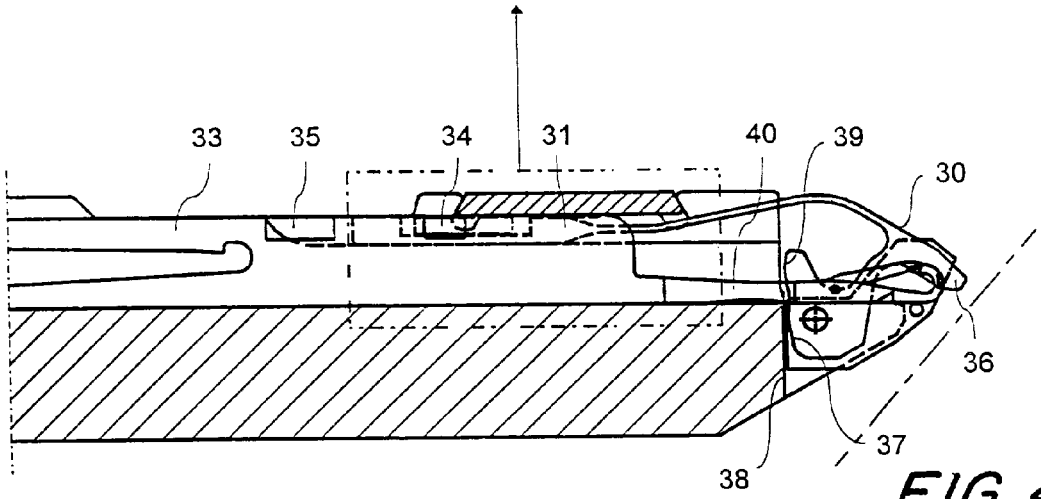
FIG. 4 is a view showing a cross-section through a needle bed with a side view of a needle and a second embodiment of a holding down plate.
Figure 4B:
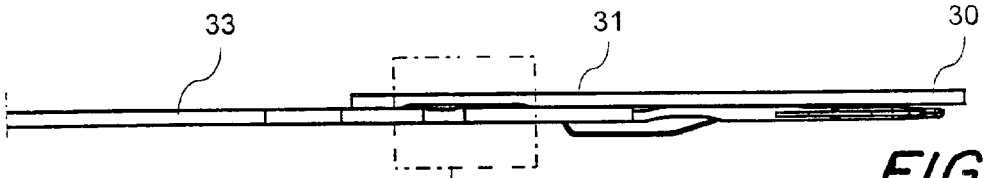
FIG. 4B is a view from above on the needle and the plate of FIG. 4.
Figure 4C:
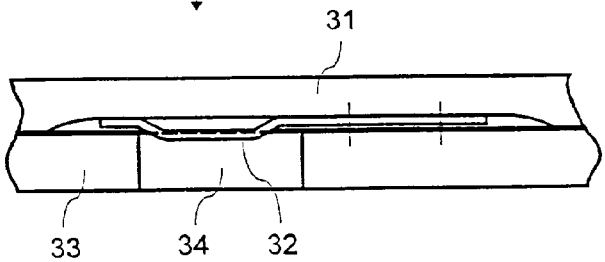
FIG. 4C is an enlarged view of a detail of FIG. 4.2.

FIGS. 4, 4.1–4.3 show a holding down plate 30 which is driveable by a needle 40. The plate 30 is open in a tension-free condition. Its plate shaft 31 has no plate foot extending perpendicular from the needle bed, but instead is provided with a laterally mounted flat spring 32 shown in FIG. 4.3. Due to its design, the flat spring 32 can form a form-locking connection or a frictional connection to the needle shaft 33. Two recesses 34 and 35 are provided in the needle shaft, and the flat spring 32 can engage in them. When the needle 40 is located in its basic position, the plate 30 is engaged with its flat spring 32 into the groove 34. In this position the operational part of the plate 30 is closed over substantially three fourth, this position is shown in FIG. 4. When the needle 4 starts its advanced movement, the plate 30 is taken with it so that its operational part is circularly closed. Thereby the loops located in the needle hooks are held back during the needle advance.

When the closing movement of the operational part 33 is finished, the plate 30 is supported with its abutment surface 37 on a back 38 of a lateral guiding groove for the operational part 36. When the needle 40 is advanced further, the rear edge of the recess 34 compresses the flat spring 32. Subsequently, the flat spring 32 provides a frictional connection to the needle shaft 33 so that the operational part 36 of the plate 30 remains further closed. Shortly before the needle 40 reaches the position "Tuck height", the flat spring 32 slides into the second recess 35. The plate 30 is now uncoupled from the needle 40 so that due to the restoring force accumulated in the web of the plate 40, the operational part 36 opens the plate 30 again. Thereby an unobjectionable tuck insertion of a tuck leg is possible. During the subsequent back pulling movement of the needle 40, the operational 36 remains open.

If no tuck leg but instead a loop must be formed, the needle is not moved back but instead is driven further. A form lock of the flat spring 32 with the second recess 35 takes place, whereby the plate 30 is again moved together with the needle 40. Thereby the operational part 36 closes again and remains closed during the forward movement of the needle. When the needle 40 starts its return movement, an opening position of the operational part 36 is obtained by a frictional connection between the needle shaft 33 and the flat spring 32. A surface 39 of the plate 30 comes to abutment against the groove back 38 and thereby limits the opening movement of the operational part 36. During the whole back pulling movement of the needle 40, the operational part 46 remains open, so that an unobjectionable thread insertion is guaranteed.

After the needle 40 reaches its inner-most position, it is again displaced to its base position. Here again a frictional connection between the needle shaft 33 and the flat spring 32 is effective, whereby the operational part 36 is closed. When the needle 40 reaches its base position, the flat spring 32 again snaps into the recess 34, whereby the plate 30 is open again over the last quarter of its closing path.

Instead of the flat spring 32 which engages in the recesses 34 and 35 on the needle shaft 33, naturally also other elements and constructions can be used for producing a frictional connection and/or form-locking connection between the needle 40 and the plate 30.

It will be understood that each of the elements described above, or two or more together, may also find a useful application in other types of constructions differing from the types described above.

While the invention has been illustrated and described as embodied in knitting machine, in particular flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A knitting machine, comprising a needle bed; a plurality of needles; plates arranged between said needles, each of said plates having a front operational part displaceable about an axis extending along said needle bed between a front position and a rear position, and a shaft part arranged substantially parallel to said needles and longitudinally displaceable for driving said plates, said operational part and said shaft part being connected by an elastic springy web to form a one-piece element.

2. A knitting machine as defined in claim 1, wherein said plates are in one piece.

3. A knitting machine as defined in claim 1, wherein said operational part, said shaft part and said elastical springy web of said plates are formed as three separate elements which are connected with one another to form said one-piece elements; and further comprising means for connecting said operational part, said shaft part and said elastic springy web with one another.

4. A knitting machine as defined in claim 3, wherein said connecting means include a laser welding seam.

5. A knitting machine as defined in claim 3, wherein said connecting means include a microconnecting structure.

6. A knitting machine as defined in claim 1; and further comprising means forming a guiding surface over which at least said operational part of said plates is guided laterally.

7. A knitting machine as defined in claim 1, wherein said plates are formed so that in a relaxed condition of said web, said operational part of said plates are located in a front position.

8. A knitting machine as defined in claim 1, wherein said plates are formed so that in a relaxed condition of said web said operational parts of said plates are located in a rear position.

9. A knitting machine as defined in claim 1, wherein said plates are formed so that in a relaxed condition of said web, said operational parts of said plates are located between a front position and a rear position.

10. A knitting machine as defined in claim 1; and further comprising a plate cam which engages said shaft parts of said plates for controlling said plates.

11. A knitting machine as defined in claim 10, wherein said shaft parts of said plates have a foot extending perpendicular from said needle bed, said plate cam having a cam part engaging with said foot.

12. A knitting machine as defined in claim 1, wherein said plates are connectable with neighboring ones of said needles by a frictional connection and moveable together with said neighboring needles.

13. A knitting machine as defined in claim 1, wherein said plates are connectable with neighboring ones of said needles by a form-locking connection and moveable together with said neighboring needles.

14. A knitting machine as defined in claim 1, wherein said needles have needle shafts provided with recesses, said shaft parts of said plates being provided laterally with flat spring elements insertable in said recesses.

15. A knitting machine as defined in claim 14, wherein said needle shaft has two such recesses which are arranged one behind the other, so that said flat spring element of said shaft part of neighboring plates is insertable after one another during a needle advance with abutment of said operational part of said plate after reaching its front position against an abutment, whereby said flat spring element slides from a front one of said recesses to a rear one of said recesses.

* * * * *